US006910237B2

(12) United States Patent
DiGirolamo

(10) Patent No.: US 6,910,237 B2
(45) Date of Patent: Jun. 28, 2005

(54) PILLOW COVER WITH CLOSURE AND POUCH MEMBER THEREFOR

(75) Inventor: Shelley A. DiGirolamo, Bellevue, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 10/359,865

(22) Filed: Feb. 7, 2003

(65) Prior Publication Data

US 2004/0154101 A1 Aug. 12, 2004

(51) Int. Cl.[7] ..... A47G 9/10
(52) U.S. Cl. ..... 5/636; 5/645; 5/490
(58) Field of Search ..... 5/417, 419, 636, 5/645, 490, 485; 383/4

(56) References Cited

U.S. PATENT DOCUMENTS

| | | | | | |
|---|---|---|---|---|---|
| 1,871,003 | A | * | 8/1932 | Longletz et al. | 5/490 |
| 3,162,868 | A | * | 12/1964 | Cramer | 5/490 |
| 3,863,283 | A | * | 2/1975 | Mohr | 5/639 |
| 4,277,859 | A | * | 7/1981 | Seaman | 5/639 |
| 4,375,111 | A | * | 3/1983 | Hall | 5/419 |

* cited by examiner

*Primary Examiner*—Michael Trettel
(74) *Attorney, Agent, or Firm*—Jensen & Puntigam, P.S.

(57) ABSTRACT

A pillow cover and pouch combination where the cover is adapted to receive a pillow therein, the cover having first and second identical sections, each section including outer and inner fabric portions with a layer of down filling therebetween. The first and second sections are secured together by a line of stitching around three sides, the other side being open to receive a conventional pillow, closeable by a closure element. The pouch member is configured such that the cover may be folded and positioned inside to produce a pillow-like member.

7 Claims, 3 Drawing Sheets

PILLOW COVER WITH CLOSURE AND POUCH MEMBER THEREFOR

TECHNICAL FIELD

This invention relates generally to pillows and accessories for pillows, and more specifically concerns the combination of a pillow cover and pouch.

BACKGROUND OF THE INVENTION

There are many known pillow covers, used for various purposes. Many pillow covers, such as shown in U.S. Pat. No. 6,209,156, are for protecting the pillow itself from stains or soiling during use. In some cases, the cover is discarded after use, while in others, the cover may be conveniently washed. Other pillow covers, such as shown in U.S. Pat. Nos. 4,508,044, 4,165,125 and 4,480,347, are for specialized purposes, such as decoration, rebuilding of an existing pillow, or adapting a pillow for a particular use, among others. However, none of these pillow covers are directed toward the specific purpose/function of applicant's invention, i.e. a pillow cover which is useful in increasing the comfort of an existing pillow while also being adapted for use with a pouch such that the cover can itself function as a small pillow suitable for travel or similar purposes.

SUMMARY OF THE INVENTION

Accordingly, the present invention is a pillow cover and pouch combination kit, comprising: a cover adapted to receive a pillow therein, the cover having first and second sections securable together around the peripheries thereof, each section including outer and inner fabric portions with a layer of filling therebetween; a closure element for first and second sections; and a pouch member into which said cover may be folded to produce a pillow-like member.

BEST MODE FOR CARRYING OUT THE INVENTION

Figures 1A, 1B:
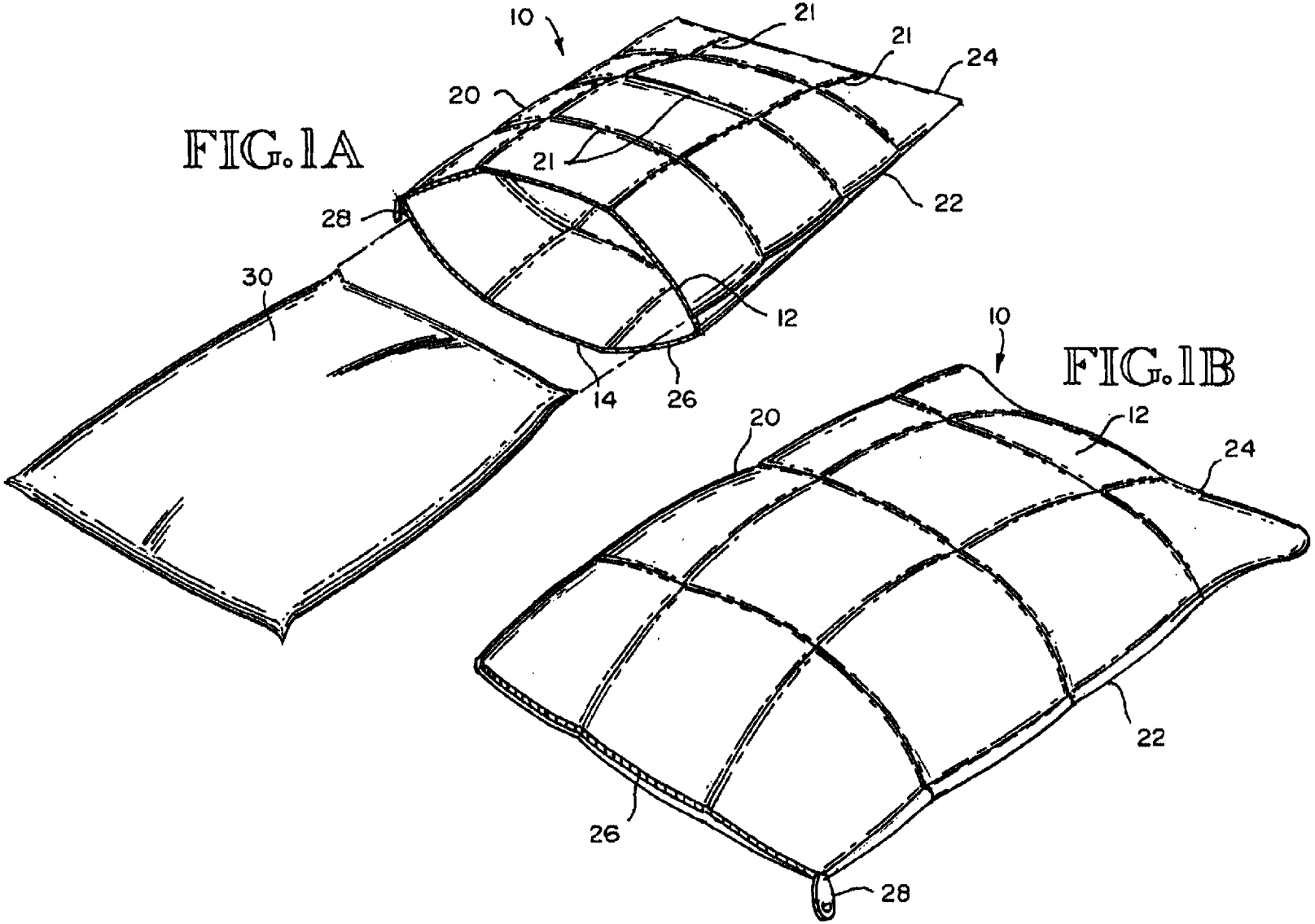
FIGS. 1A and 1B are perspective views showing the pillow cover portion of the combination of the present invention with a conventional pillow about to be inserted therein and fully inserted therein, respectively.
Figure 2:
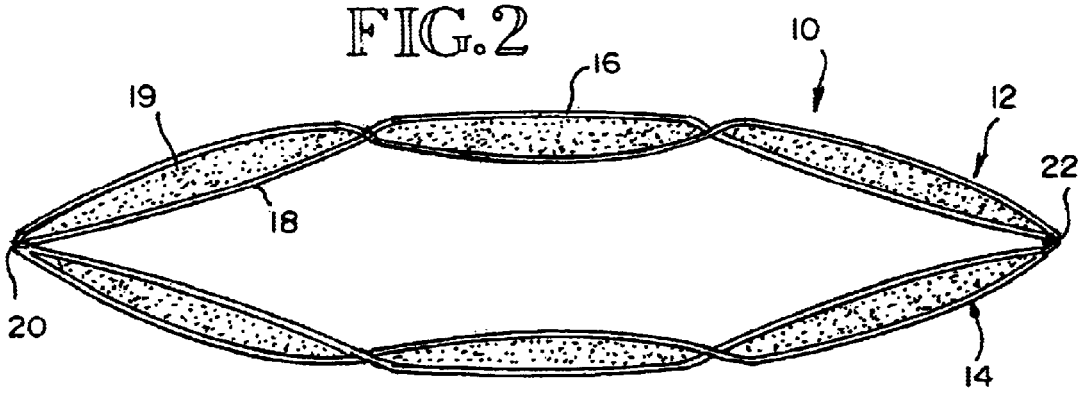
FIG. 2 is a cross-sectional view of the pillow cover of FIG. 1.

FIGS. 1A, 1B and 2 show the pillow cover portion of the pillow/pouch combination of the present invention, generally at 10. In the embodiment shown, the cover 10 comprises first and second sections 12 and 14 which are identical in size and configuration, each being approximately 20 inches by 26 inches, which is a convenient size to receive most pillows. Each section (section 12 is exemplary) includes outer and inner fabric portions 16 and 18. Between the two fabric portions 16 and 18 is positioned a volume of down, feathers or similar material 19. It could be man-made material, such as artificial down. For the size of the cover shown, the filling will have a weight within the range of 5–7 oz, but preferably approximately 5 oz. Each fabric portion is quilted by stitching together, along lines of stitching 21—21 the two fabric portions in a pattern of squares, in addition to around the peripheries of the two portions, each square being approximately 6.5 inches on a side.

The first and second fabric sections 12 and 14 are secured along two longitudinal sides 20 and 22 (the long sides) and one end side 24. The securement is typically permanent, in the form of stitching or the like. The remaining end side 26 is open, but is closeable by means of a zipper or similar closing device 28. Alternatives include snaps, buttons, Velcro® fasteners or other similar devices.

In use of the pillow cover, a conventional pillow 30 is inserted into the cover through open end side 26. End side 26 is then closed. The cover 10 is typically used when away from home, providing additional comfort which the user may be accustomed to, without having to take their home pillow with them. When the user leaves, the end side 26 is simply unzipped and the pillow removed. The cover 10 may be folded and conveniently stowed in a suitcase, typically in a protective bag of some kind. The cover can also be conveniently used with a home pillow, to extend the life of the home pillow.

Figure 3:
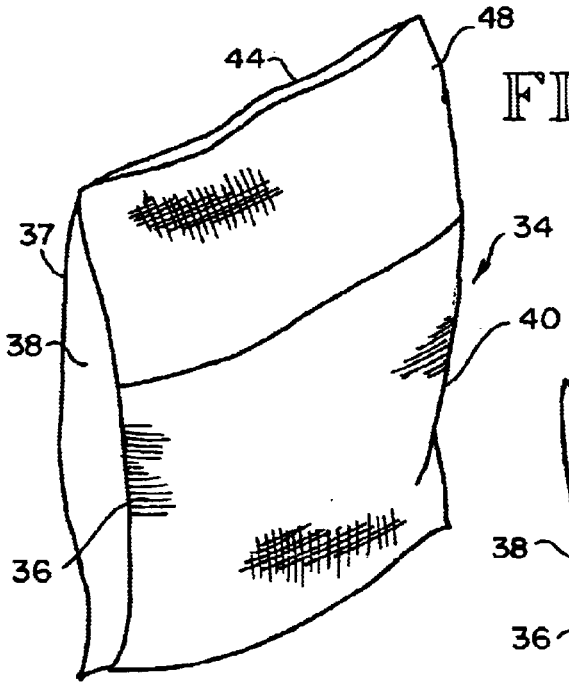
FIG. 3 shows a pouch member portion of the combination with an upper flap part thereof folded open for insertion of the folded pillow cover.
Figure 4:
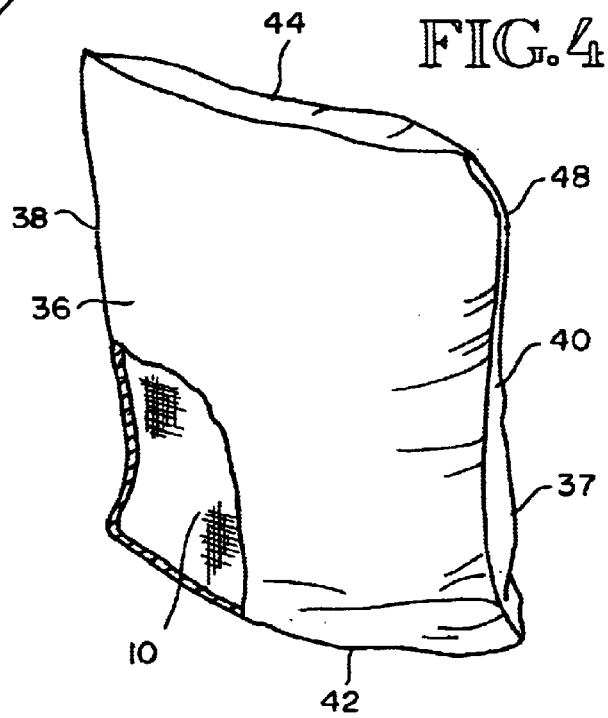
FIG. 4 shows the pouch member with the folded pillow cover positioned inside the pouch and the flap part closed.
Figure 5:
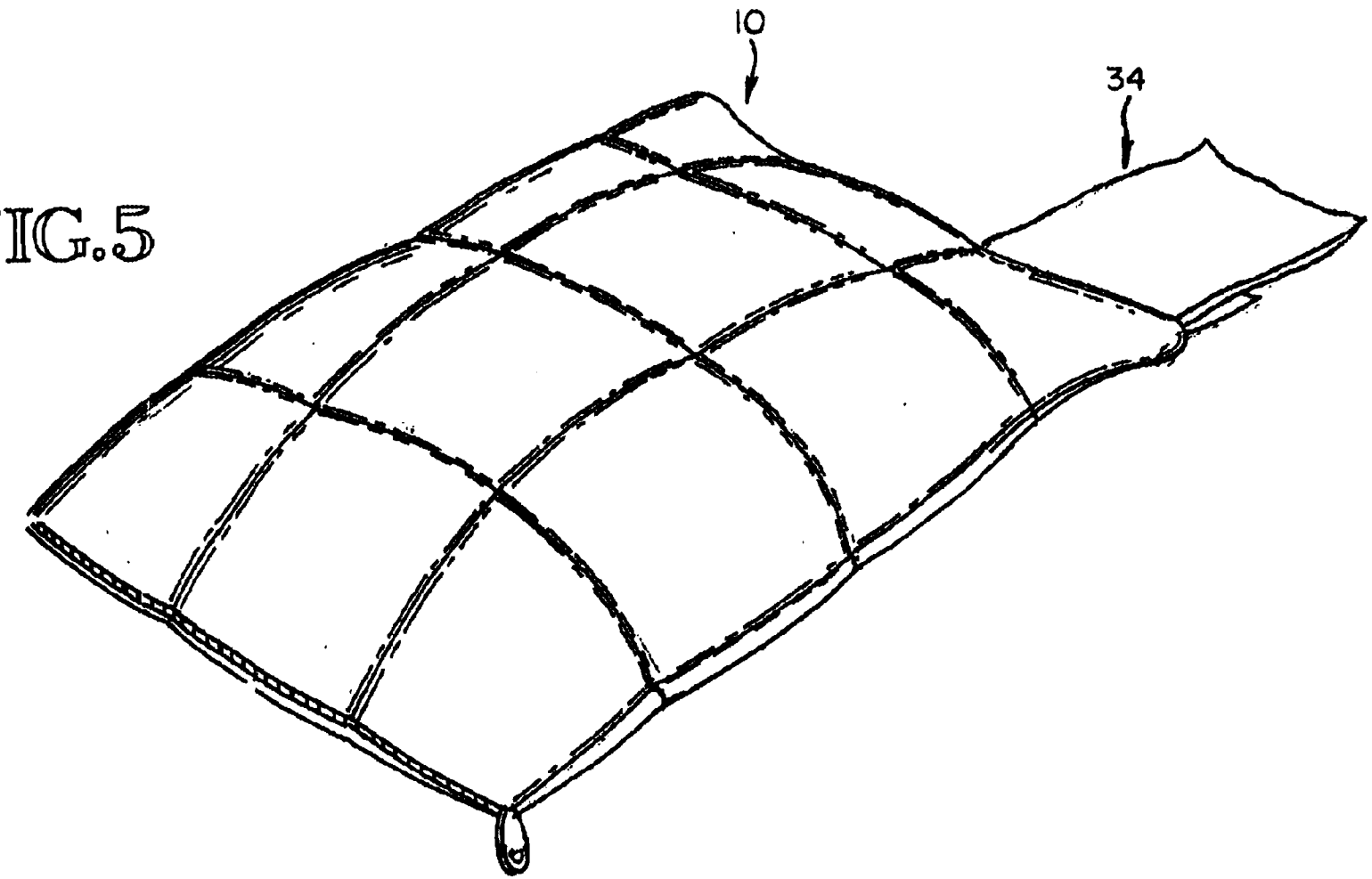
FIG. 5 shows the pouch member portion secured to the pillow cover.

FIG. 3 shows a pouch portion of the combination which is designed to hold a folded-up cover 10. The pouch, shown generally at 34, comprises two fabric sections 36, 37, each rectangular in the embodiment shown, approximately 11 inches by 9 inches. The fabric sections are of cotton or similar material and are sewn together along two longitudinal sides 38 and 40 and one end side 42, leaving opposing end side 44 open.

Extending from open side 44 is a flap 48, which in the embodiment shown is approximately 3½ inches high, and extends across the entire end side 44. Cover portion 10 of the combination can be conveniently folded and positioned within pouch 34. Flap 48 is then folded over the open end side 44 to effectively close the pouch. The result is a small pillow which can be conveniently used for travel or other situations where there is no standard pillow available. The pillow-like comfort is produced by the down filling or the like in the two sections 12 and 14 of the cover. For convenience, the pouch could be attached to the cover 10 or form a part thereof.

The combination of the present invention is thus a pillow cover which provides additional comfort for a conventional pillow, and with the pouch can serve as a pillow, such as for travel or other situations.

Although a preferred embodiment of the invention has been described for purposes of illustration, it should be understood that various changes, modification and substitutions may be incorporated in the embodiment without departing from the spirit of the invention which is defined in the claims which follow.

What is claimed:

1. A pillow cover and pouch combination kit, comprising:

a pillow cover adapted to receive a pillow therein, the pillow cover having first and second sections securable together around the peripheries thereof, each section including outer and inner fabric portions with a layer of conventional pillow filling therebetween, wherein the pillow cover is structurally adapted in size, configuration and amount of filling therein, in the range of 5 to 7 ounces, to receive a pillow without distorting the shape or configuration of the received pillow;

a closure element for closing the first and second sections; and a pouch member associated with the pillow member, the pouch member having such a size and configuration and otherwise adapted to receive said pillow cover to produce in combination a pillow member suitable ea a travel pillow.

2. A kit of claim 1, wherein the closure member is a zipper.

3. A kit of claim 1, wherein the filling is down filling.

4. A kit of claim 1, wherein the pouch member is secured to the cover.

5. A kit of claim 1, wherein the first and second sections are rectangular, secured together by a line of stitching around two longitudinal sides and one end side, the other opposing end side being open and closeable by the closure element.

6. A kit of claim 1, wherein the pouch member has the dimensions of a small pillow.

7. A kit of claim 1, wherein the outer and inner fabric portions are cotton, and wherein the pouch member is also cotton.

* * * * *